US009239146B2

(12) United States Patent
Walker et al.

(10) Patent No.: US 9,239,146 B2
(45) Date of Patent: Jan. 19, 2016

(54) BULKHEAD LIGHT FITTING AND LIGHTING METHOD

(71) Applicant: Custom Molded Products, Inc., Newnan, GA (US)

(72) Inventors: Victor L. Walker, Temecula, CA (US); Angelo V. Pugliese, Jr., Newnan, GA (US)

(73) Assignee: Custom Molded Products, Inc., Newnan, GA (US)

( * ) Notice: Subject to any disclaimer, the term of this patent is extended or adjusted under 35 U.S.C. 154(b) by 247 days.

(21) Appl. No.: 14/077,349

(22) Filed: Nov. 12, 2013

(65) Prior Publication Data

US 2015/0131268 A1 May 14, 2015

(51) Int. Cl.

| | |
|---|---|
| ***F21S 8/00*** | (2006.01) |
| ***F21V 13/02*** | (2006.01) |
| ***F21V 3/00*** | (2015.01) |
| ***F21S 8/02*** | (2006.01) |
| ***F21V 17/00*** | (2006.01) |
| ***F21V 21/04*** | (2006.01) |
| *F21W 131/401* | (2006.01) |

(52) U.S. Cl.

CPC . *F21V 13/02* (2013.01); *F21S 8/02* (2013.01); *F21V 3/00* (2013.01); *F21V 17/002* (2013.01); *F21V 21/04* (2013.01); *F21W 2131/401* (2013.01); *Y10T 29/49948* (2015.01)

(58) Field of Classification Search

CPC ..... F21V 13/02; F21V 17/002; F21S 8/02; F21S 8/00

USPC ..... 362/101

See application file for complete search history.

(56) References Cited

U.S. PATENT DOCUMENTS

| | | | | | |
|---|---|---|---|---|---|
| 4,617,615 | A * | 10/1986 | Eychaner | F21S 8/00 | 362/216 |
| 6,002,216 | A * | 12/1999 | Mateescu | F21S 8/00 | 315/158 |
| 2006/0163374 | A1* | 7/2006 | Wooten | B05B 17/08 | 239/18 |
| 2007/0279900 | A1* | 12/2007 | Bauer | F21S 8/00 | 362/158 |
| 2015/0131272 | A1* | 5/2015 | Walker | F21S 8/00 | 362/154 |

* cited by examiner

*Primary Examiner* — Anabel Ton

(74) *Attorney, Agent, or Firm* — Laurence P. Colton; Smith Risley Tempel Santos LLC

(57) ABSTRACT

A light fitting and method for illuminating the exterior of spas, swimming pools, hot tubs, garden baths, and the like, the light fitting having a base component mounted through a spa wall; a lens or light diffuser on an exterior end of the base component; a light source on, in, or proximal to an interior end of the base component; a light clip for retaining the light source on, in, or proximal to the base component; a light shade located on or proximal to the exterior end of the base component; and an attachment plate for attaching the light shade onto the base component via a mounting support; the base component having a cylindrical hollow body having a hollow interior, a first end located within the spa wall, and a second end located proximal to the spa wall, with the mounting support being attached to the cylindrical hollow body.

18 Claims, 11 Drawing Sheets

BULKHEAD LIGHT FITTING AND LIGHTING METHOD

BACKGROUND OF THE INVENTION

1. Technical Field

The present invention generally is in the field of lighting devices and methods for spas, swimming pools, hot tubs, garden baths, and the like. The present invention more particularly is in the field of lighting devices and methods for illuminating the exterior of and/or the area surrounding spas, swimming pools, hot tubs, garden baths, and the like. The present invention more particularly also is in the field of lighting devices and methods for generating aesthetically pleasing light on and around spas, swimming pools, hot tubs, garden baths, and the like. The present invention more particularly also is in the field of lighting devices and lighting methods having a permanent or semi-permanent lighting base with removable and replaceable covers and shades having different aesthetic designs and shapes.

2. Prior Art

Few applications derive more benefit from the addition of aesthetically pleasing and/or safety lighting than artificial bodies of water such as spas, swimming pools, hot tubs, garden baths, and the like. The popularity of lighting features and methods of lighting and/or illuminating the interior, exterior, and features of such structures is probably associated with the numerous aesthetic and practical applications that make lighting desirable. For example, the addition of a lighting feature or the illumination of already present on or features added to such structures can provide a substantial decorative effect to, or can provide a relaxing background visual experience for, or can provide for increased safety when using, such structures. As such, users and owners of such structures, which include all such artificial bodies of water as well as many natural bodies of water, often desire the addition of lighting features to and methods of lighting or illuminating such structures.

Many existing spas, swimming pools, hot tubs, garden baths, and the like include some type of lighting feature to add to the aesthetics of the device. In some existing spas, swimming pools, hot tubs, garden baths, and the like, the lighting feature is located on a feature of the device, such as on a waterfall or waterjet, for providing an aesthetically pleasing water flow. In other existing spas, swimming pools, hot tubs, garden baths, and the like, the lighting feature is located on the decking or the exterior of such structures or as separate lighting devices, such as lamps, for providing ambient lighting or safety lighting. In yet other existing spas, swimming pools, hot tubs, garden baths, and the like, the lighting feature is located within the tub of water, also for providing ambient lighting and safety lighting. As the market for spas, swimming pools, hot tubs, garden baths, and the like grows, users desire more, different, better, more interesting, and more aesthetically pleasing lighting devices and methods of lighting to make, for example, their bathing experience more relaxing, more convenient, and safer.

Accordingly, there is a need for new and different lighting devices and methods for illuminating the exterior of and/or the area surrounding spas, swimming pools, hot tubs, garden baths, and the like, and for lighting devices and methods for generating aesthetically pleasing light on and around spas, swimming pools, hot tubs, garden baths, and the like. There also is a need for new and different lighting devices and methods for illuminating the exterior of and/or the area surrounding spas, swimming pools, hot tubs, garden baths, and the like, and for lighting devices and methods for generating aesthetically pleasing light on and around spas, swimming pools, hot tubs, garden baths, and the like having a permanent or semi-permanent lighting base with removable and replaceable covers and shades having different aesthetic designs and shapes. There is a further need for new and different lighting devices and methods for illuminating the exterior of and/or the area surrounding spas, swimming pools, hot tubs, garden baths, and the like, and for lighting devices and methods for generating aesthetically pleasing light on and around spas, swimming pools, hot tubs, garden baths, and the like having a permanent or semi-permanent lighting base with removable and replaceable covers and shades whereby the spa, swimming pool, hot tub, garden bath, or the like can be customized by the owner. It is to these needs and others that the present invention is directed.

BRIEF SUMMARY OF THE INVENTION

In the present specification, spas, swimming pools, hot tubs, garden baths, saunas, or the like, including artificial water structures, all will be referred to as a "spa" or "spas".

Briefly described, the present invention is a bulkhead light fitting for placement on or through a spa wall, and preferably on or through an outer decorative or supporting wall. In preferred embodiments, the present invention provides light or illumination for the exterior of the spa and/or the area surrounding the spa. The light provided for by the invention can be for aesthetic purposes, such as ambient, decorative, architectural, or mood lighting, or for safety purposes.

Currently, lights attached to the outside walls of spas, spa walls, and/or spa shells risk being damaged or broken both during normal spa use and during the shipping and installation of the spa. With the permanently installed lights that are the current state of the art, this can mean expensive repairs. As such, the current state of the art is to use small lighting fixtures and/or no or small light shades. The present invention provides for a relatively low profile light having a mounting feature to which light shades can be removably attached. This provides at least four advantages. First, this allows the use of larger light shades as the light shades can be mounted on the spa after the spa has been shipped and installed, thus reducing shipping and installation damage. Second, the low profile of the light fixture without the light shade attached allows a more efficient shipping and installation process as the light fixture does not get in the way of shipping or installation and may even provide for a smaller shipping container. Third, as the light shade is replaceable, the user can replace the light shade if damaged or broken, or at the user's desire if a different aesthetic or functional light shade design is desired. Fourth, the spa manufacturer can make larger light shades and light fixtures that are more appropriate to the size of the spa, especially for larger spas.

In preferred embodiments, the present invention comprises a one or two piece structured or molded base component that is mounted through the spa wall, a nut for securing the base component on the wall, a lens or light diffuser, a light source, a light clip for retaining the light source on the base component, a decorative and/or functional light shade, and an attachment plate for attaching the light shade onto the base component. Various other nuts, clips, gaskets, washers, and connecting components, such as mechanical and electrical components for holding the invention securely onto the spa wall and for providing power to the light source also may be required for proper, desired, or optimal function of the invention.

The base component preferably is either one or two pieces and preferably is formed at least partially out of a transparent, semi-transparent, or translucent material capable of transmitting light. The base component comprises a generally planar mounting support attached normal to a generally cylindrical hollow body. A first end of the body, the first end located within the spa wall enclosure, is open, and a second end of the body, the second end located proximal to the spa wall, terminates at the mounting support, and can be closed or open depending on whether a one piece or two piece design is used.

The mounting support is structured to cooperate with the attachment plate for mounting the light shade on the mounting support on the exterior of the spa wall. In a one piece embodiment of the base component, the mounting support comprises the lens or light diffuser, which acts as the closed second end of the body. In a two piece embodiment of the base component, the mounting support comprises a central hole generally coextensive with and leading to the cylindrical interior of the body, and cooperating with the open second end of the body.

The lens or light diffuser allows the transmission of light from the light source to the exterior of the spa. In a one piece embodiment of the base component, the lens or light diffuser is formed as part of the mounting support, preferably located as a generally central portion of the mounting support, and acts as the closed second end of the body. In a two piece embodiment of the base component, the lens or light diffuser, or at least a portion of the lens or light diffuser, is a separate component that is mounted within a central hole through the mounting support, the central hole being generally coextensive with and leading to the cylindrical interior of the body, with the lens or light diffuser, or the portion of the lens or light diffuser, cooperating with the open second end of the body so as to effectively close the open second end when the lens or light diffuser, or the portion of the lens or light diffuser, is installed.

The base component further comprises at least one light clip connector for allowing the attachment of the light clip. The light clip connector also preferably is formed at least partially from a transparent, semi-transparent, or translucent material, and preferably from the same material as the lens or light diffuser, so that light emanating from the light source can travel directly through the light clip connector and the lens or light diffuser, which light then can be transmitted onto the exterior of the spa or to the area surrounding the spa. A T-shaped light clip connector is a representative light clip connector shape so as to cooperate with a C-shaped connector on the light clip.

The light clip is for holding a light source, such as a light emitting diode (LED) or other light emitting device, and can be attached to a light clip connector. The light clip comprises a tubular structure for containing and/or supporting the light source and a connector for attaching the light clip to the light clip connector. The connector for attaching the light clip to the light clip connector can be structured to cooperate with the light clip connector on the housing, or can be a spring clip or a connectorless connection device. When the light clip is attached to the light clip connector, the light source is in a position to provide light to the lens or light diffuser.

The attachment plate is for attaching a light shade to the base component, generally via the mounting support. In a preferred embodiment, the mounting support is a generally rectangular and generally planar or flat structure, or comprises coplanar components, that, when the invention is properly mounted on a spa, lie generally coplanar with the spa wall exterior, so as to preferably provide a low profile of the invention relative to the spa wall. The attachment plate is an arch or tunnel entrance shaped component having a region shaped for cooperating with the shape of the mounting support, a region for allowing light from the lens or light diffuser to pass through to the light shade or exterior of the spa, and a region comprising locking or attachment clips, or other equivalent means, for holding the attachment plate onto the mounting support.

The light shade is a decorative component to which the attachment plate is secured, either releasably or preferably permanently. The light shade can be any type of shade or covering that can be attached to the attachment plate whereby the combined light shade and attachment plate can be mounted on the mounting support.

In use, the bulkhead light fitting can be attached to the spa wall, for example, at the manufacturing location, at the sales location, at the installation location, or after the spa has been installed. In an exemplary embodiment, the base component is attached to the spa wall by drilling a hole through the spa wall, inserting the body of the base component through the hole from the exterior of the spa such that the rear side of the mounting support contacts the exterior side of the spa wall, screwing a nut onto the screw thread on the exterior of the body, and tightening the nut up against the interior side of the of the spa wall such that the spa wall is sandwiched between the nut and the rear side of the mounting support. A light source is inserted into the structure for containing and/or supporting the light source of the light clip and the light clip is attached to the light clip connector within the hollow interior of the body. A light shade, attached or to be attached to the attachment plate, is selected and is attached to the mounting support. When properly installed, the region for allowing light from the lens or light diffuser to pass through to the light shade lines up with the lens or light diffuser such that light passing through the lens or light diffuser is not blocked by the attachment plate and the light can proceed to and/or through the light shade.

If the base component is attached to the spa wall at the manufacturing location, the spa can be shipped, moved, and installed without fear of breaking the light shade. After the spa is installed, the light shade can be mounted onto the mounting support. If the base component is attached to the spa wall after the spa has been installed, the light shade can be mounted onto the mounting support at the time of installation. No matter when the base component is installed on the spa wall, the light shade can be easily replaced without disassembling the invention or the spa. Additionally, if a user decides to change the light shade, this can be easily done without disassembling the spa. Further, with the two piece embodiment of the base component, the light source can be easily replaced from the exterior of the spa by removing the light shade and removing the lens or light diffuser component, which will include removing the light clip connector, the light clip, and the light source.

The bulkhead light fitting can be used on almost any artificial water body. While the bulkhead light fitting is described in connection with a spa, it is understood that the bulkhead light fitting can be used on spas, swimming pools, tubs, and the like. One of ordinary skill in the art can modify the bulkhead light fitting without undue experimentation so that it can be placed on almost any artificial water body. Thus, the invention can be installed on spa wall to provide for the addition of aesthetically pleasing, decorative, architectural, and/or safety light to a spa or the area surrounding a spa.

One feature of the invention is that the base component is securely attached to the spa and is located generally flush or nearly flush with the spa wall exterior, while the light shade, which often extends outwardly from the spa wall, is removable and replaceable. As such, the spa can be shipped, moved, and installed without the light shade, thereby reducing or eliminating the chance that the light shade will be damaged during such shipping, moving, or installing. The light shade also can be replaced if broken without replacing the entire lighting system. Further, the user can select and install any of a number of different light shades at the user's desire so as to customize the spa.

These features, and other features and advantages of the present invention will become more apparent to those of ordinary skill in the relevant art when the following detailed description of the preferred embodiments is read in conjunction with the appended drawings in which like reference numerals represent like components throughout the several views.

DETAILED DESCRIPTION OF THE PREFERRED EMBODIMENTS

Figure 1:
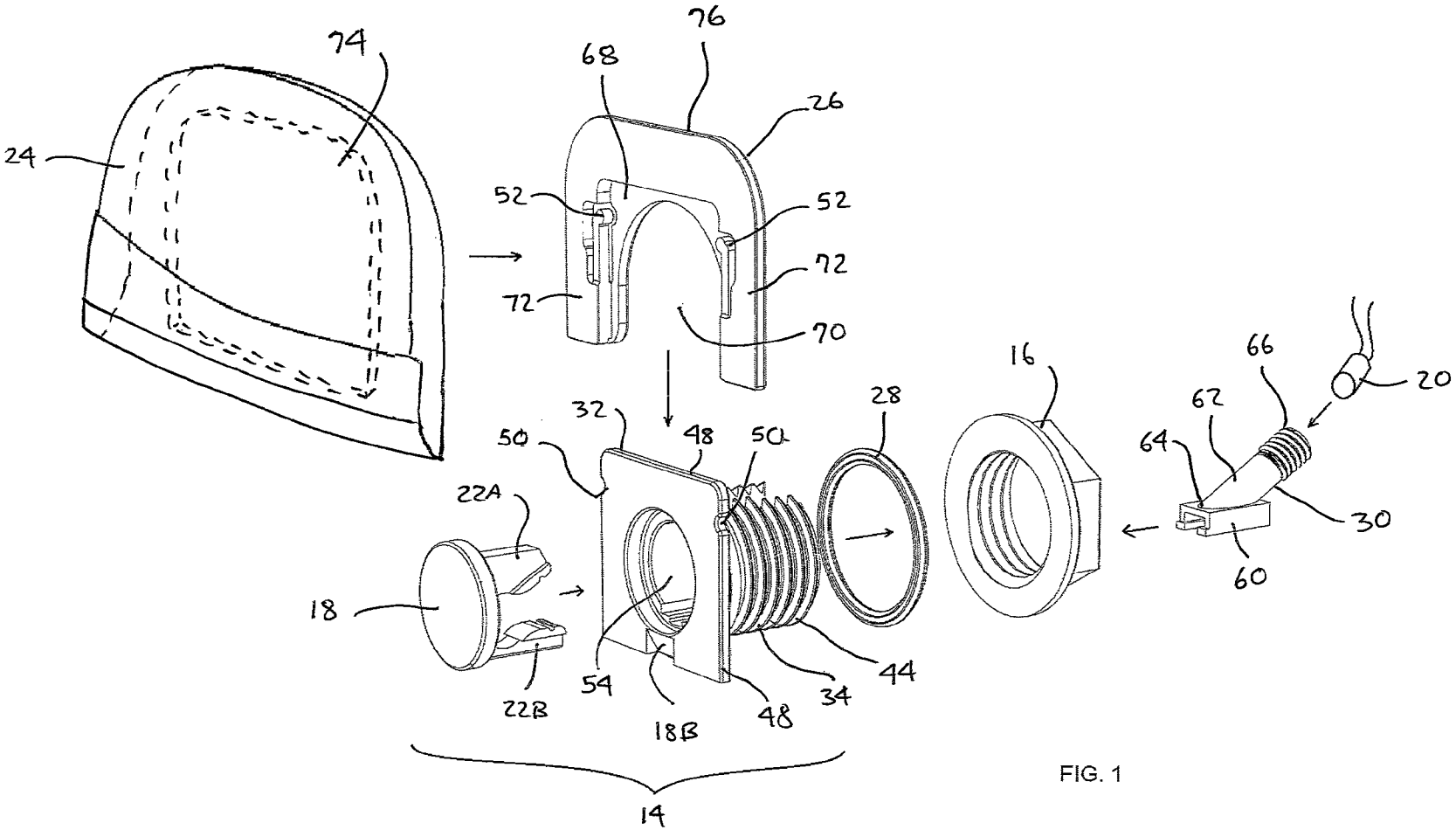
FIG. 1 is an exploded perspective view of an embodiment of the invention.
Figure 2:
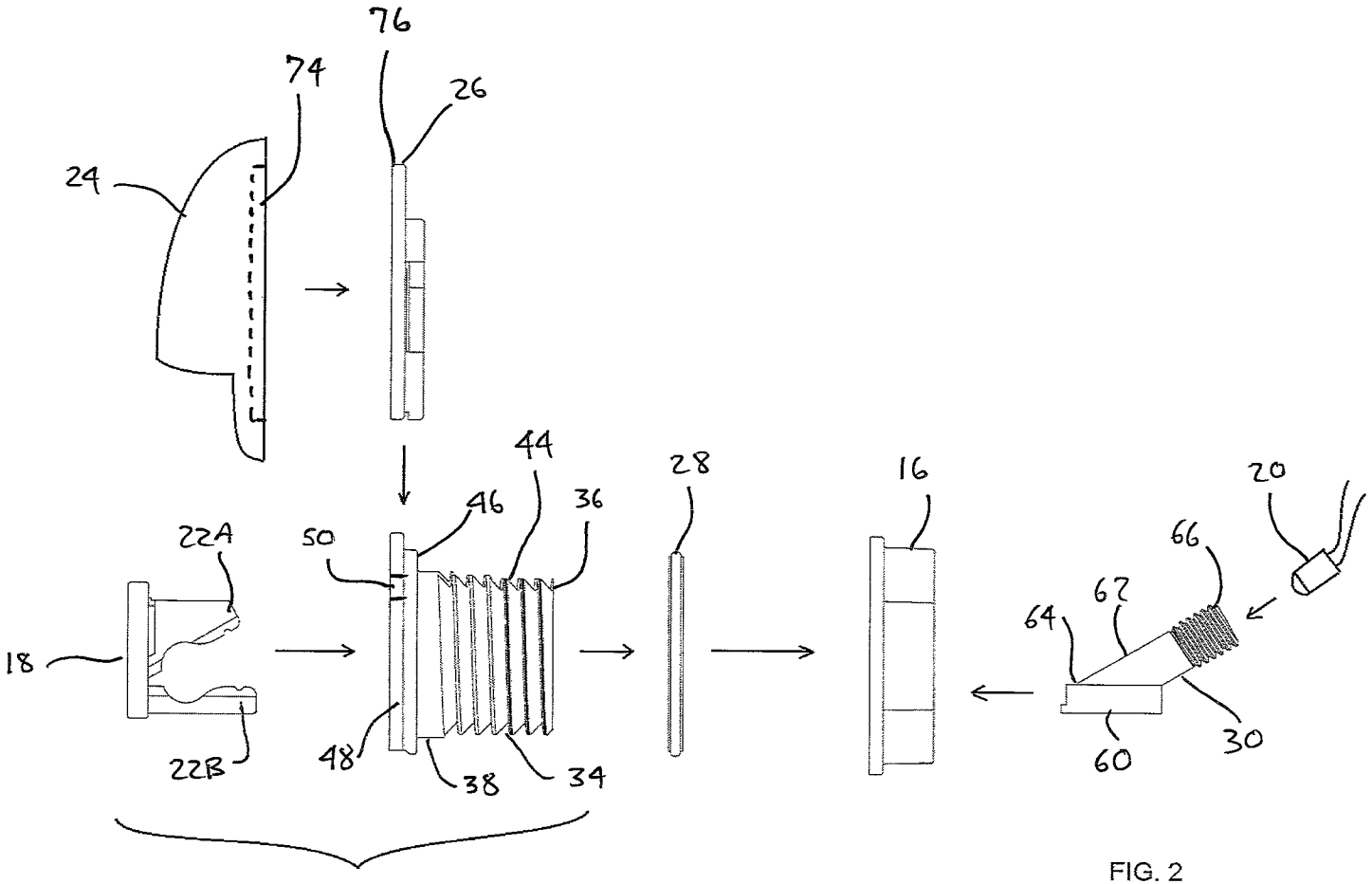
FIG. 2 is an exploded side view of an embodiment of the invention.
Figure 3:
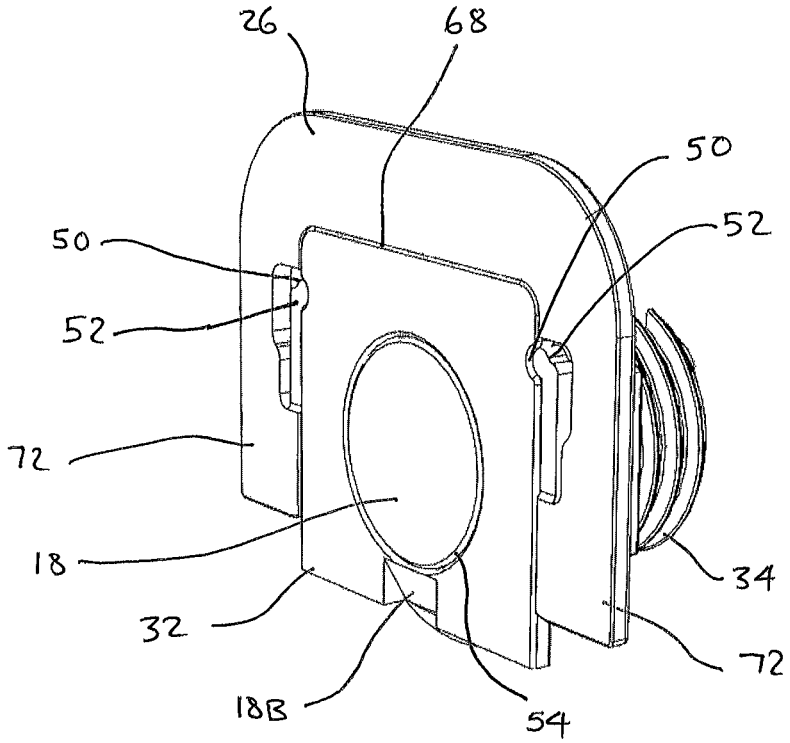
FIG. 3 is a perspective front view of an embodiment of the invention.
Figure 4:
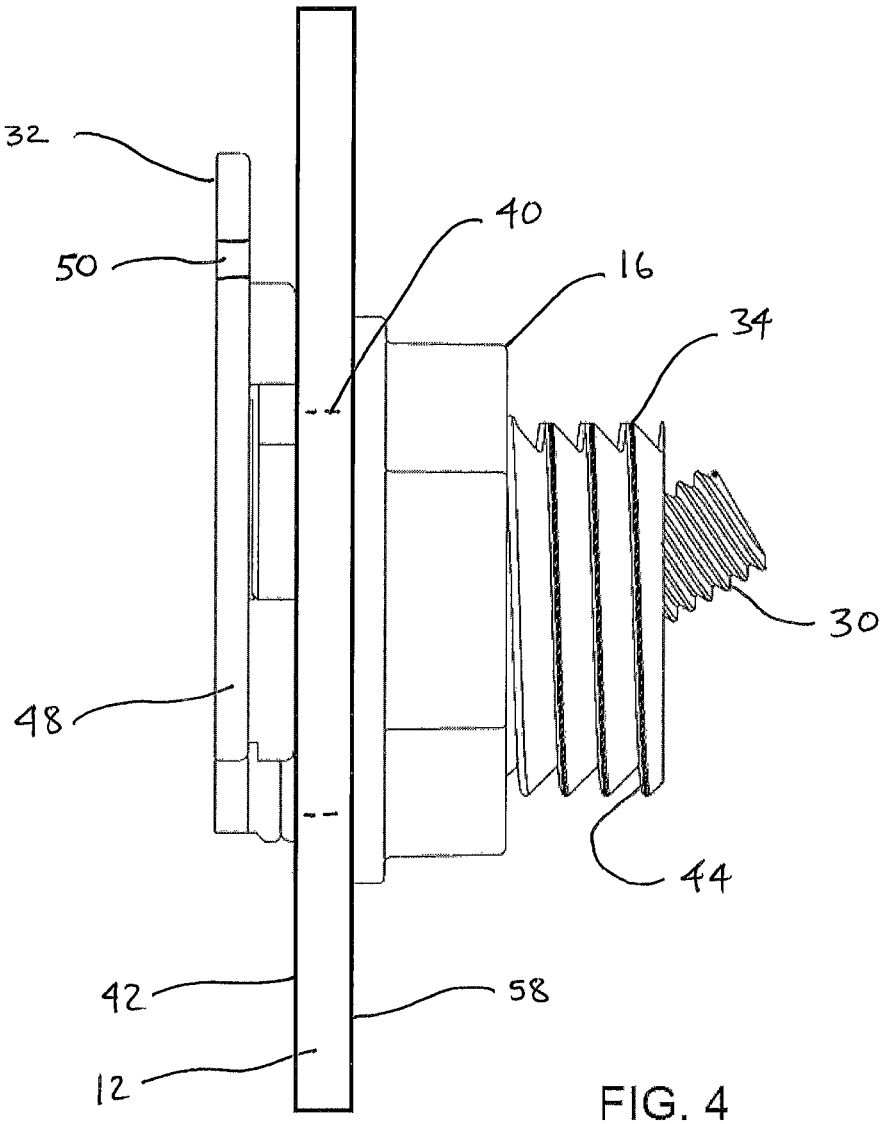
FIG. 4 is a side view of an embodiment of the invention.
Figure 5:
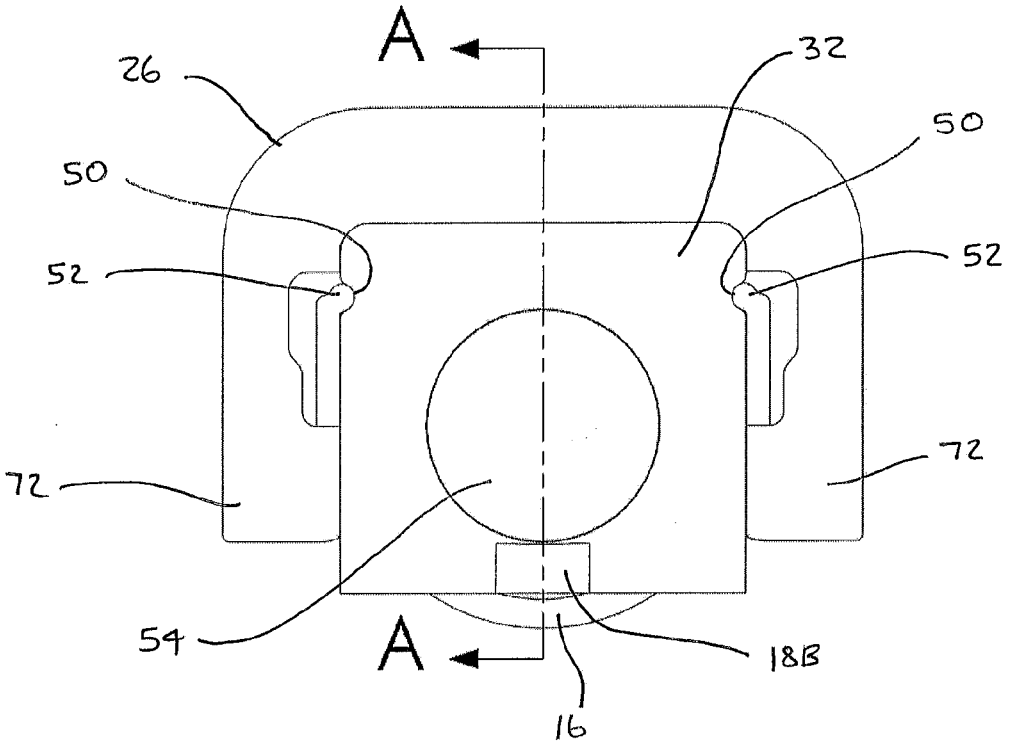
FIG. 5 is a front view of an embodiment of the invention.
Figure 6:
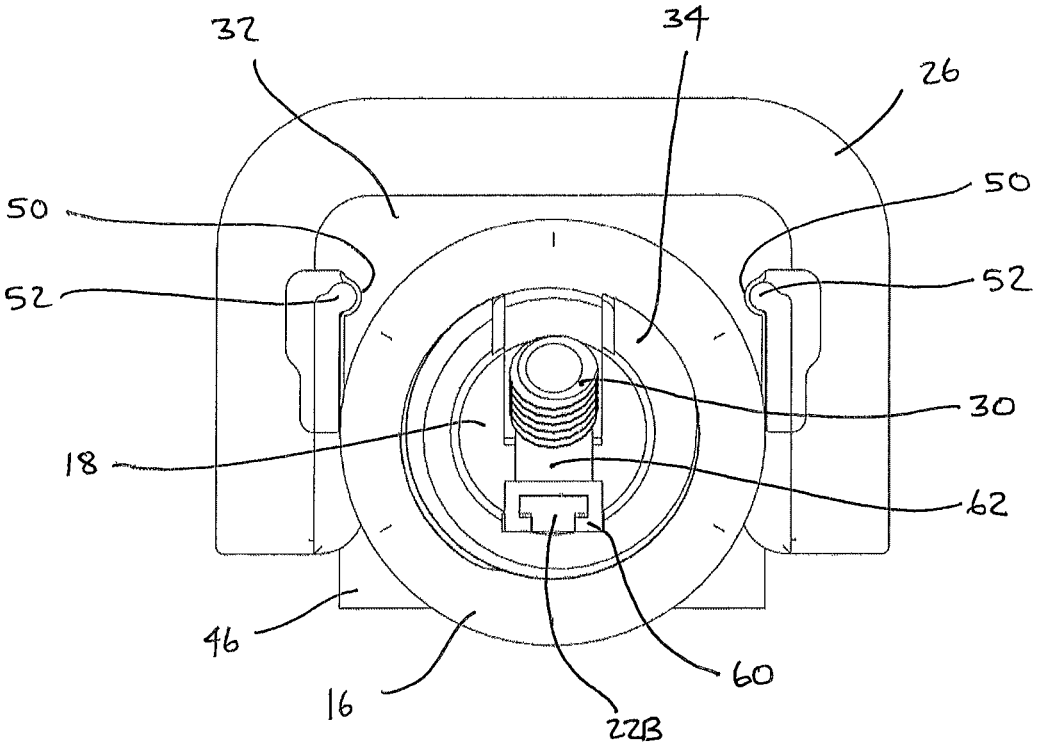
FIG. 6 is a rear view of an embodiment of the invention.
Figure 7:
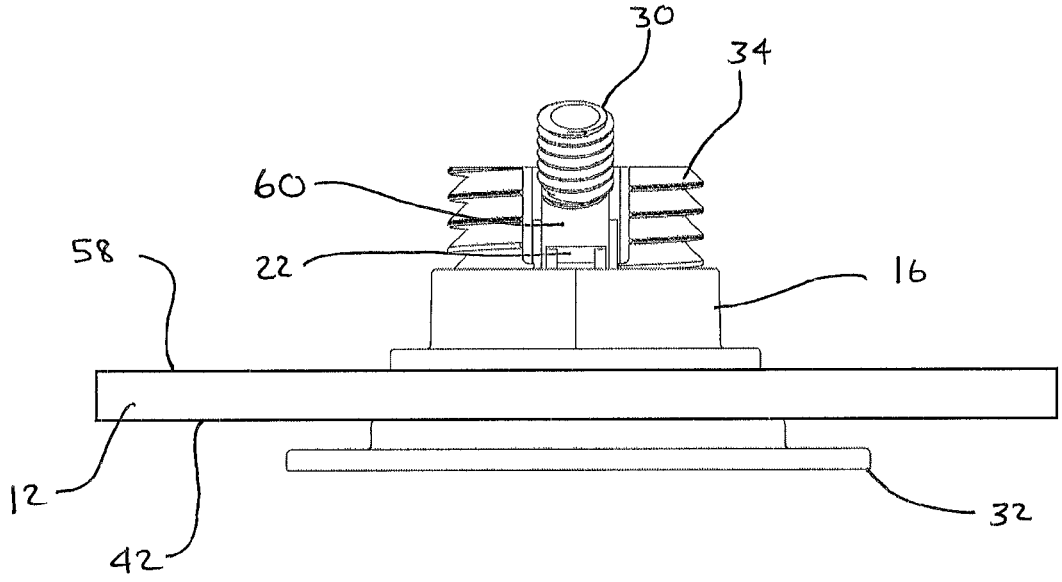
FIG. 7 is a top view of an embodiment of the invention.
Figure 8:
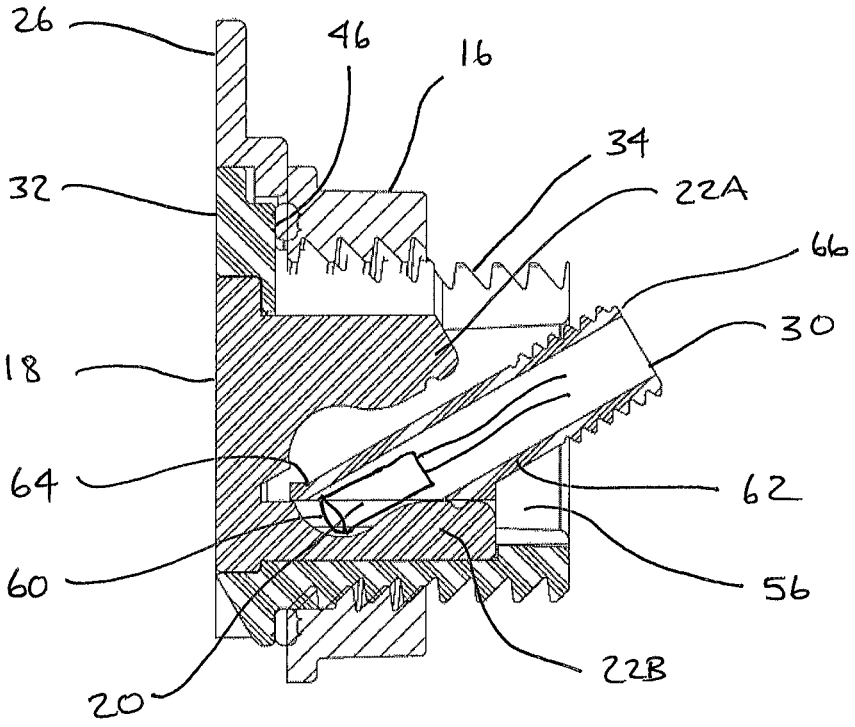
FIG. 8 is a sectional side view of an embodiment of the invention along section line A-A of FIG. 5.
Figure 9:
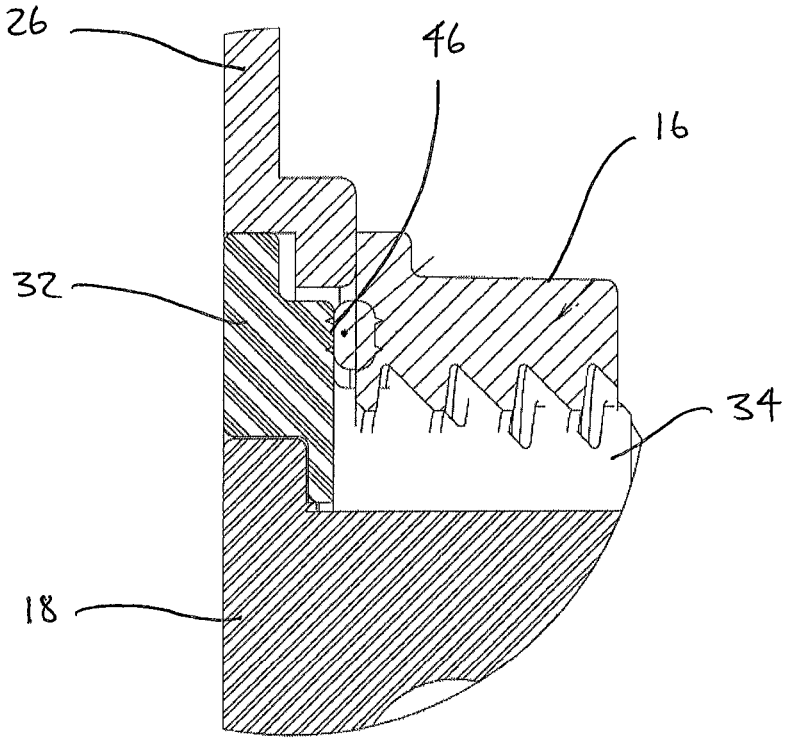
FIG. 9 is a sectional side view of the embodiment of the invention of FIG. 8 in greater detail.
Figure 10:
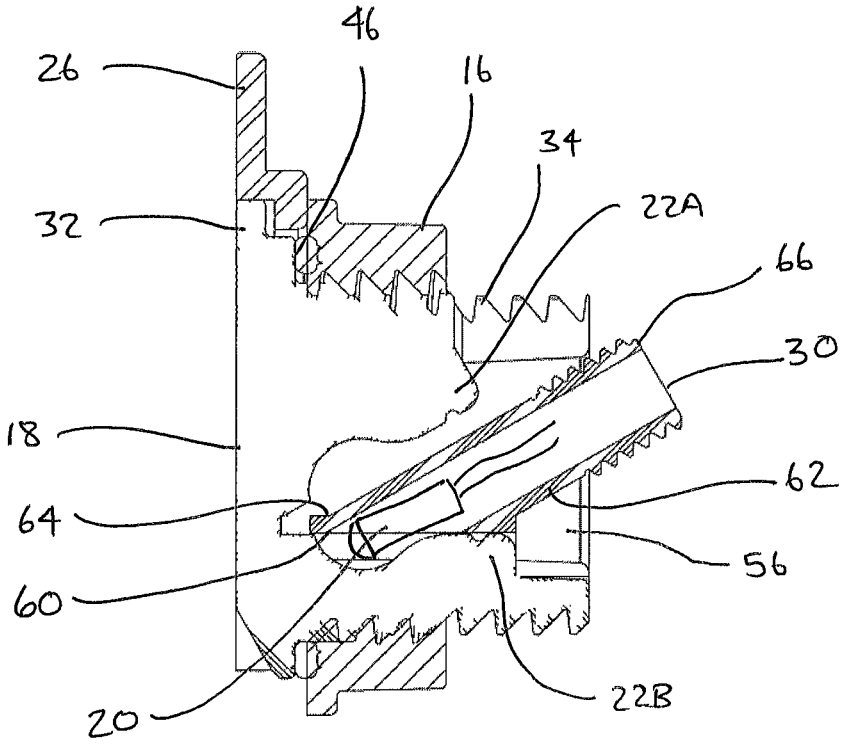
FIG. 10 is a sectional side view of an embodiment of the invention along section line A-A of FIG. 5.
Figure 11:
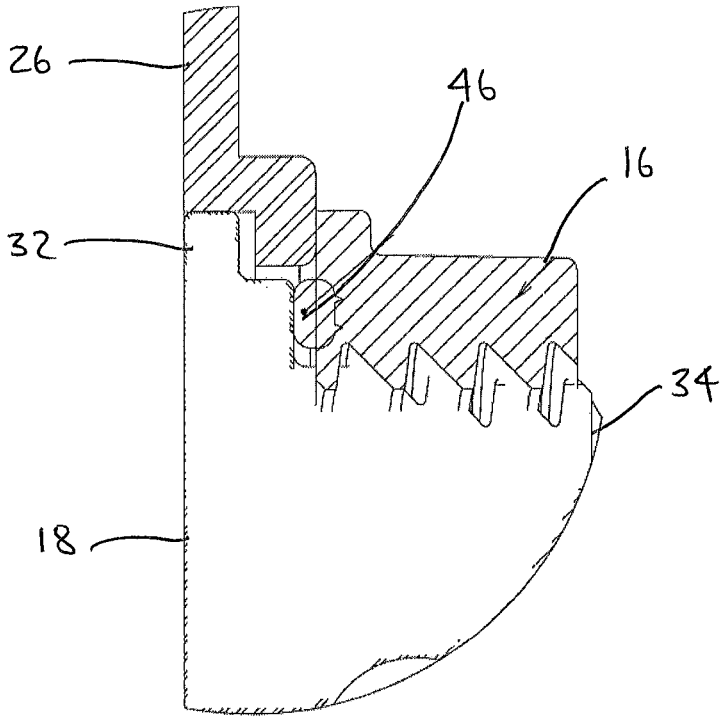
FIG. 11 is a sectional side view of the embodiment of the invention of FIG. 10 in greater detail.

Illustrative embodiments of a bulkhead light fitting 10 according to the present invention are shown in FIGS. 1 through 11. FIG. 1 is an exploded perspective view of an embodiment of the invention and FIG. 2 is an exploded side view of the embodiment shown in FIG. 1, with a two-piece base component 14. FIG. 3 is a perspective front view of an embodiment of the invention shown in unexploded form and FIG. 4 is a side view of an embodiment shown in FIG. 3, installed on a spa wall 12. FIG. 5 is a front view of an embodiment of the invention, in a simplified schematic form. FIG. 6 is a rear view of an embodiment of the invention and FIG. 7 is a top view of an embodiment of the invention, installed on a spa wall 12. FIG. 8 is a sectional side view of an embodiment of the invention along section line A-A of FIG. 5, with a two-piece base component 14. FIG. 9 is a sectional side view of the embodiment of the invention of FIG. 8 in greater detail. FIG. 10 is a sectional side view of an embodiment of the invention along section line A-A of FIG. 5, with a one-piece base component 14. FIG. 11 is a sectional side view of the embodiment of the invention of FIG. 10 in greater detail.

The present invention is a bulkhead light fitting 10 for placement on or through a spa wall 12, and preferably on or through an outer decorative or supporting wall. In preferred embodiments, the present invention provides light or illumination for the exterior of the spa and/or the area surrounding the spa. The light provided for by the invention can be for aesthetic purposes, such as ambient, decorative, architectural, or mood lighting, or for safety purposes.

In preferred embodiments, the present invention comprises a one or two piece structured or molded base component 14 that is mounted through the spa wall 12, a nut 16 or other means for securing the base component 14 on the wall 12, a lens or light diffuser 18, a light source 20, a light clip 30 for retaining the light source 20 on the base component 14, a decorative and/or functional light shade 24, and an attachment plate 26 for attaching the light shade 24 onto the base component 14. Various other nuts, clips, gaskets 28, washers, and connecting components, such as mechanical and electrical components for holding the invention securely onto the spa wall 12 and for providing power to the light source 20 also may be required for proper, desired, or optimal function of the invention.

The base component 14 preferably is either one or two pieces and preferably is formed at least partially out of a transparent, semi-transparent, or translucent material capable of transmitting light. The base component 14 comprises a generally planar mounting support 32 attached normal to a generally cylindrical hollow body 34. A first end 36 of the body 34, the first end 36 located within the spa wall enclosure, is open, and a second end 38 of the body 34, the second end 38 located proximal to the spa wall 12, terminates at the mounting support 32, and can be closed or open depending on whether a one piece or two piece design is used. The body 34 is inserted through a cooperating hole 40 through the spa wall 12 such that the mounting support 32 lies flat against or proximal to the exterior surface 42 of the spa wall 12. The body 34 has a screw thread 44 on an outer surface for cooperating with a nut 16 for securing the base component 14 onto the spa wall 12. For example, the spa wall 12 is sandwiched between the nut 16 and the rear side 46 of the mounting support 32.

The mounting support 32 is structured to cooperate with the attachment plate 26 for mounting the light shade 24 on the mounting support 32 on the exterior 42 of the spa wall 12. For example, the mounting support 32 can have surfaces 48 for releasably supporting the attachment plate 26 and notches 50 for cooperating with spring clips 52 on the attachment plate 26 for releasably securing the attachment plate 26 onto the mounting support 32. In a one piece embodiment of the base component 14, the mounting support 32 comprises the lens or light diffuser 18, which acts as the closed second end 38 of the body 34. In a two piece embodiment of the base component 14, the mounting support 32 comprises a central hole 54 generally coextensive with and leading to the interior 56 of the body 34, and cooperating with the open first end 36 of the body 34. The mounting support 32 should be sufficiently larger than the hole 40 through the spa wall 12 such that the mounting support 32 cannot pass through the hole 40 through the spa wall 12.

The lens or light diffuser 18 allows the transmission of light from the light source 20 to the exterior of the spa. In a one piece embodiment of the base component 14, the lens or light diffuser 18 is formed as part of the mounting support 32, preferably located as a generally central portion of the mounting support 32, and acts as the closed second end 38 of the body 34. In a two piece embodiment of the base component 14, the lens or light diffuser 18, or at least a portion of the lens or light diffuser 18, is a separate component that is mounted within a central hole 54 through the mounting support 32, the central hole 54 being generally coextensive with and leading to the cylindrical interior 56 of the body 34, with the lens or light diffuser 18, or at least a portion of the lens or light diffuser 18, cooperating with the open second end 38 of the body 34 so as to effectively close the open second end 38 when the lens or light diffuser 18, or at least a portion of the lens or light diffuser 18, is installed. In a one piece embodiment, the light source 20 generally must be replaced from the interior side 58 of the spa wall 12. In a two piece embodiment, the lens or light diffuser 18, or at least a portion of the lens or light diffuser 18, can be removed from the exterior side 42 of the spa and the light source 20 can be replaced from the exterior side 42 of the spa wall 12.

The base component 14 further comprises at least one light clip connector 22 for allowing the attachment of the light clip 30. The light clip connector 22 also preferably is formed at least partially from a transparent, semi-transparent, or translucent material, and preferably from the same material as the lens or light diffuser 18, so that light emanating from the light source 20 can travel directly through the light clip connector 22 and the lens or light diffuser 18, which light then can be transmitted onto the exterior side 42 of the spa or to the area surrounding the spa. A first light clip connector 22A can extend rearwardly from the rear side of the lens or light diffuser 18 into the hollow interior 56 of the body 34 at a position and at an appropriate angle whereby when a light clip 30 is attached to the first light clip connector 22A, light emanating from the light source 20 travels straight through the lens or light diffuser 18 in a path generally coaxial with the body 34 and thereby preferably causing the lens or light diffuser 18 to be mostly or all illuminated and to illuminated a general area on the exterior side 42 of or surrounding the spa. A second light clip connector 22B can extend rearwardly from the rear side of the lens or light diffuser 18 into the hollow interior 56 of the body 34 at a position and at an appropriate angle whereby when a light clip 30 is attached to the second light clip connector 22B, light emanating from the light source 20 travels at an angle to an edge of the lens or light diffuser 18 in a path generally not coaxial with the body 34 and thereby preferably causing a directional portion 18B of the lens or light diffuser 18 to be illuminated and to illuminated a specific area on the exterior side 44 of or surrounding the spa. For example, the directional portion 18B of the lens or light diffuser 18 can be angled downwards so as to provide light to a path located next to the spa. A T-shaped light clip connector 22 is a representative light clip connector 22 shape so as to cooperate with a C-shaped connector 60 on the light clip 30.

The light clip 22 is for holding a light source 20, such as a light emitting diode (LED) or other light emitting device, and can be attached to a light clip connector 22. The light clip 30 comprises a tubular structure 62 for containing and/or supporting the light source 20 and a connector 60 for attaching the light clip 30 to the light clip connector 22. Light clip 30 is shown as a cylindrical body as the tubular structure 62 in a roughly angular configuration relative to connector 60. Light clip 30, and specifically the tubular structure 62, is structured to contain the light source 20 and to allow any of the necessary wires, batteries, or other means for supplying electricity or other power to the light source 20. Light clip 30 can be a cup-like structure having an open bottom 64 and an open top 66. Alternatively, bottom 64 can be closed. Bottom 64 can be configured to rest snugly against light clip connector 22 or lens or light diffuser 18 such that light from the light source 20 is more efficiently provided to lens or light diffuser 18. Other embodiments of the light clip 30 also allow for the tubular structure 62 and the connector 60 to be in a perpendicular configuration, a parallel configuration, or at other angles to each other.

The tubular structure 62 for containing and/or supporting the light source 20 can be of various sizes and shapes depending on the desired light source 20. For example, a relatively small cylindrical structure can be used as the tubular structure 62 for LEDs and mini-bulbs while a relatively large hollow structure can be used for more conventional or older bulbs. The connector 60 for attaching the light clip 30 to the light clip connector 22 can be structured to cooperate with the light clip connector 22, or can be a spring clip or other connectorless connection device. For example, the connector 60 can be a C-shaped structure to slide over and frictionally connect to a T-shaped light clip connector 22. When the light clip 30 is attached to the light clip connector 22, the light source 20 is in a position to provide light to the lens or light diffuser 18. The exact shape of the connector 60 should match and cooperate with the shape of the light clip connector 22 as disclosed herein.

Light clip 30 and light clip connector 22 allow for light to be directed at the lens or light diffuser 18 such that the lens or light diffuser 18 can be illuminated, and the illumination to be seen on the exterior side 42 of the spa or in an area surrounding the exterior of the spa. Light clip 30 cooperates with light clip connector 22 to securely but removably hold light clip 30 onto light clip connector 22. One or more light clip connectors 22, such as angled light clip connector 22A and straight light clip connector 22B, as well as additional light clip connectors 22, can be used to direct the light from the light source 20 in different directions through the lens or light diffuser 18. For example, with the structure of light clip 30 shown in the figures, light clip connector 22A directs the light from light source 20 generally straight into lens or light diffuser 18, thereby illuminating most or the entire lens or light diffuser 18. This configuration is meant to provide light generally to the light shade 24 for illuminating a wider area on the exterior of the spa. For another example, with the structure of light clip 30 shown in the figures, light clip connector 22B directs the light from light source 20 generally into directional lens or light diffuser 18B, thereby illuminating directional lens or light diffuser 18B and possibly only a portion of the lens or light diffuser 18. This configuration is meant to provide light generally downward to a path area or a selected area immediately below where the bulkhead light fitting 10 is mounted on the spa shell 12. The lens or light diffuser, the directional lens or light diffuser 18B, and the light clip connectors 22 all can be structured or placed on the bulkhead light fitting 10 so as to provide amounts of light or directions of light as desired by the manufacturer or user.

The attachment plate 26 is for attaching a light shade 24 to the base component 14, generally via the mounting support 32. In a preferred embodiment, the mounting support 32 is a generally rectangular and generally planar or flat structure, or comprises coplanar components, that, when the invention is properly mounted on a spa, lie generally coplanar with the spa wall 12 exterior side 42. The attachment plate 26 is an arch or tunnel entrance shaped component having a mounting region 68 shaped for cooperating with the shape of the mounting support 32, a region for allowing light from the lens or light diffuser 18 to pass through to the light shade 24 or exterior side 42 of the spa, and a region comprising locking or attachment clips 52 for holding the attachment plate 26 onto the mounting support 32. The mounting region 68 shaped for cooperating with the shape of the mounting support 32 can be an indentation in the attachment plate 26 having the same general shape as the mounting support 32 such that the mounting support 32 can fit within the mounting region 68 shaped for cooperating with the shape of the mounting support 32. The region for allowing light from the lens or light diffuser 18 to pass through to the light shade 24 or exterior side 42 of the spa can be a hole or cutout 70 having the same general shape as the lens or light diffuser 18 such that light passing through the lens or light diffuser 18 is not blocked by the attachment plate 26 and the light can proceed to and/or through the light shade 24. The region comprising locking or attachment clips for holding the attachment plate onto the mounting support can be the outer edges 72 or portions of the attachment plate 26 at least partially surrounding the mounting region 68 shaped for cooperating with the shape of the mounting support 32 so as to secure the attachment plate 26 onto the mounting support 32. The attachment clips 52 can be spring clips, knobs, or bumps that cooperate with notches 50 on the mounting support 32 for releasably securing the attachment plate 26 onto the mounting support 32.

For ease of orientation, it is preferable that both the shape of the mounting support 32 and the shape of mounting region 68 have cooperating shapes whereby the attachment plate 26 fits in only one orientation on the mounting support 32 and whereby the attachment plate 26 will not rotate when mounted on the mounting support 32. As shown in the figures, both the shape of the mounting support 32 and the shape of the mounting region 68 are cooperating rectangle-based shapes. With such shapes, the mounting region 68 can slide down or be placed over the mounting support 32 in only one direction and also will not rotate once mounted on the mounting support 32. For comparison purposes, if the shapes of the mounting region 68 and the mounting support 32 were round, the user would have to ensure that the light shade 24 was in the proper orientation at final assembly or installation site. With, for example, non-round shapes for the mounting region 68 and the mounting support 32, the light shade 24 can only fit on the mounting support 32 in a proper orientation.

The light shade 24 also can have a shade mounting region 74 to cooperate with the attachment plate 26. As mentioned herein, the attachment plate 26 can be attached to the light shade 24 using adhesives. Alternatively, the light shade 24 can be attached to the attachment plate 26 using a shade mounting region 74 and a shade mounting support 76 configuration similar to the mounting region 68 and mounting support 32. If such a configuration is used between the light shade 24 and the attachment plate 26, the non-round shape also is preferable. That is, the light shade 24 can have a matching molded pocket or other feature(s) that fix the orientation of the attachment plate 26 to the light shade 24. The attachment plate 26 preferably also would be glued or otherwise affixed to the light shade 24 using such a shade mounting region 74 and shade mounting support 76 configuration. This in turn helps ensure the proper orientation of the light shade 24 to the mounting support 32 and thus to the spa.

The light shade 24 is a decorative and/or functional component to which the attachment plate 26 is secured, either releasably or preferably permanently. The light shade 24 can be any type of shade or covering that can be attached to the attachment plate 26 whereby the combined light shade 24 and attachment plate 26 can be mounted on the mounting support 32. The light shade 24 is for aesthetic purposes and/or for directing the light in a desired or needed direction, such as downwards to illuminate a path along the exterior of the spa.

In use, the bulkhead light fitting 10 can be attached to the spa wall 12 at the manufacturing location, at the installation location, or after the spa has been installed. In an exemplary embodiment, the base component 14 is attached to the spa wall 12 by drilling a hole 40 through the spa wall 12, inserting the body 34 of the base component 14 through the hole 40 from the exterior of the spa such that the rear side 46 of the mounting support 32 contacts the exterior side 42 of the spa wall 12, screwing a nut 16 onto the screw thread 44 on the exterior of the body 34, and tightening the nut 16 up against the interior side 58 of the of the spa wall 12 such that the spa wall 12 is sandwiched between the nut 16 and the rear side 46 of the mounting support 32. A light source 22 is inserted into the tubular structure 62 for containing and/or supporting the light source 20 of the light clip 30 and the light clip 30 is attached to the light clip connector 22, 22A, 22B within the hollow interior 56 of the body 34. A light shade 24, attached to the attachment plate 26, is selected and is attached to the mounting support 32, generally by sliding the mounting region 68 shaped for cooperating with the shape of the mounting support 32 over the mounting support 32 such that the mounting support 32 fits within the mounting region 68 shaped for cooperating with the shape of the mounting support 32 and the locking or attachment clips 52 cooperate with the notches 50 on the mounting support 32 to hold the light shade 24 and attachment plate 26 combination onto the mounting support 32. The light shade 24 and the attachment plate 26 alternatively can be manufactured as a single component. When properly installed, the cutout 70 region for allowing light from the lens or light diffuser 18 to pass through to the light shade 24 lines up with the lens or light diffuser 18 such that light passing through the lens or light diffuser 18 is not blocked by the attachment plate 26 and the light can proceed to and/or through the light shade 24.

If the base component 14 is attached to the spa wall 12 at the manufacturing location, the spa can be shipped, moved, and installed without fear of breaking the light shade 24. After the spa is installed, the light shade 24 can be mounted onto the mounting support 32. If the base component 14 is attached to the spa wall 12 after the spa has been installed, the light shade 24 can be mounted onto the mounting support 32 at the time of installation. No matter when the base component 14 is installed on the spa wall 12, the light shade 24 can be easily replaced without disassembling the bulkhead light fitting 10 or the spa. Additionally, if a user decides to change the light shade 24, this can be easily done without disassembling the spa. Further, with the two piece embodiment of the base component 14, the light source 20 can be replaced from the exterior side 42 of the spa by removing the light shade 24 and removing the lens or light diffuser component 18, which will include removing the light clip connector 22, the light clip 30, and the light source 20.

The bulkhead light fitting 10 can be used on almost any artificial water body. While the bulkhead light fitting 10 is described in connection with a spa, it is understood that the bulkhead light fitting 10 can be used on spas, swimming pools, tubs, and the like. One of ordinary skill in the art can modify the bulkhead light fitting 10 without undue experimentation so that it can be placed on almost any artificial water body. Thus, the invention can be installed on spa wall 12 to provide for the addition of aesthetically pleasing, decorative, architectural, and/or safety light to a spa or the area surrounding a spa.

One feature of the invention is that the base component 14 is securely attached to the spa and is located generally flush or nearly flush with the spa wall 12 exterior side 42, while the light shade 24, which often extends outwardly from the spa wall 12, is removable and replaceable. This feature provides at least three advantages. First, the spa can be shipped, moved, and installed without the light shade 24, thereby reducing or eliminating the chance that the light shade 24 will be damaged during such shipping, moving, or installing. Second, the light shade 24 can be replaced if broken without replacing the entire bulkhead light fitting 10. Third, the user can select and install any of a number of different light shades 24 at the user's desire so as to customize the spa.

The various components of the invention can be manufactured from relatively inexpensive materials. Preferably, the components are molded or formed from a plastic material that will not corrode or be adversely affected from the exposure to water, particularly chlorinated water, and other chemicals present in a spa setting. Such plastics and other materials are known in the art.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

LIST OF REFERENCE NUMERALS

10 bulkhead light fitting
12 spa wall
14 base component
16 nut
18 lens or light diffuser
18B directional lens or light diffuser
20 light source
22 light clip connector
22A angled light clip connector
22B straight light clip connector
24 light shade
26 attachment plate
28 gasket
30 light clip
32 mounting support
34 body
36 first end of body
38 second end of body
40 hole
42 exterior side of spa wall
44 thread
46 rear side of mounting support
48 surface
50 notches
52 spring clips
54 central hole
56 interior of body
58 interior side of spa wall
60 connector
62 tubular structure
64 bottom of light clip
66 top of light clip
68 mounting region
70 cutout
72 outer edges of attachment plate
74 shade mounting region
76 shade mounting support

What is claimed is:

1. A bulkhead light fitting comprising:

a base component that is mounted through a spa wall;

a lens or light diffuser on an exterior end of the base component;

a light source on, in, or proximal to an interior end of the base component;

a light clip for retaining the light source on, in, or proximal to the base component;

a light shade located on or proximal to the exterior end of the base component; and an attachment plate for attaching the light shade onto the base component, wherein the base component is formed at least partially out of a transparent, semi-transparent, or translucent material capable of transmitting light and comprises:

a generally cylindrical hollow body having a hollow interior, a first end located within the spa wall, and a second end located proximal to the spa wall; and a generally planar mounting support attached normal to the generally cylindrical hollow body, wherein the attachment plate is mounted onto the mounting support.

2. The bulkhead light fitting as claimed in claim 1, wherein the mounting support comprises a surface for releasably supporting the attachment plate and notches for cooperating with spring clips on the attachment plate for releasably securing the attachment plate onto the mounting support.

3. The bulkhead light fitting as claimed in claim 2, wherein the base component is a single piece comprising the body and the mounting support, the mounting support comprising the lens or light diffuser.

4. The bulkhead light fitting as claimed in claim 2, wherein the base component comprises two pieces, a first piece comprising the body and the mounting support and a second piece comprising the lens or light diffuser, wherein the mounting support comprises a central hole generally coextensive with and leading to the interior of the body, and wherein the second piece is mounted within the central hole proximal to the mounting support.

5. The bulkhead light fitting according to claim 3, wherein the lens or light diffuser allows the transmission of light from the light source to the exterior of the spa, wherein the lens or light diffuser is formed as part of the mounting support, located as a generally central portion of the mounting support and acts as a closed second end of the body.

6. The bulkhead light fitting according to claim 4, wherein the lens or light diffuser allows the transmission of light from the light source to the exterior of the spa, wherein the lens or light cooperates with an open second end of the body so as to effectively close the open second end when the lens or light diffuser is installed, and wherein the lens or light diffuser is removable from the exterior of the spa and the light source is replaceable from the exterior side of the spa wall.

7. The bulkhead light fitting as claimed in claim 2, wherein the base component further comprises at least one light clip connector for allowing the attachment of the light clip to the base component, wherein the at least one light clip connector is:

a first light clip connector extending rearwardly from a rear side of the lens or light diffuser into the hollow interior of the body at a position and at an appropriate angle whereby when the light clip is attached to the first light clip connector, light emanating from the light source travels straight through the lens or light diffuser in a path generally coaxial with the body and thereby causing the lens of light diffuser to be mostly or all illuminated and causing the illumination of a general area on the exterior of or surrounding the spa; or a second light clip connector extending rearwardly from the rear side of the lens or light diffuser into the hollow interior of the body at a position and at an appropriate angle whereby when the light clip is attached to the second light clip connector, light emanating from the light source travels at an angle to an edge of the lens or light diffuser in a path generally not coaxial with the body and thereby causing only a portion of the lens of light diffuser to be illuminated and causing the illumination of a specific area on the exterior of or surrounding the spa.

8. The bulkhead light fitting as claimed in claim 7, wherein the light clip connector is formed at least partially from a transparent, semi-transparent, or translucent material, so that light emanating from the light source travels through the light clip connector and the lens or light diffuser, which light then is transmitted onto the exterior of the spa or to the area surrounding the spa.

9. The bulkhead light fitting as claimed in claim 7, wherein the light clip comprises a tubular structure for containing and/or supporting the light source and a connector for attaching the light clip to the light clip connector.

10. The bulkhead light fitting as claimed in claim 7, wherein the mounting support has a generally rectangular shape and a generally planar or flat structure or comprises generally flat and coplanar components, whereby when the invention is properly mounted on a spa, the mounting support lies generally coplanar with the spa wall exterior.

11. The bulkhead light fitting as claimed in claim 10, wherein the attachment plate is an arch or tunnel entrance shaped component comprising:

a region shaped for cooperating with the shape of the mounting support;

a region for allowing light passing through the lens or light diffuser passes through to the light shade or exterior of the spa; and a region comprising locking or attachment clips for holding the attachment plate onto the mounting support.

12. The bulkhead light fitting as claimed in claim 11, wherein:

the region shaped for cooperating with the shape of the mounting support is an indentation in the attachment plate having the same general shape as the mounting support such that the mounting support fits within the region shaped for cooperating with the shape of the mounting support;

the region for allowing light from the lens or light diffuser to pass through to the light shade or exterior of the spa is a hole or cutout having the same general shape as the lens or light diffuser such that light passing through the lens or light diffuser is not blocked by the attachment plate and the light can proceed to and/or through the light shade; and the region comprising locking or attachment clips for holding the attachment plate onto the mounting support is outer edges or portions of the attachment plate at least partially surrounding the region shaped for cooperating with the shape of the mounting support so as to secure the attachment plate onto the mounting support.

13. The bulkhead light fitting as claimed in claim 11, wherein both the shape of the mounting support and the shape of mounting region have cooperating shapes whereby the attachment plate fits in only one orientation on the mounting support and whereby the attachment plate will not rotate when mounted on the mounting support.

14. The bulkhead light fitting as claimed in claim 13, wherein both the shape of the mounting support and the shape of the mounting region are non-round.

15. The bulkhead light fitting as claimed in claim 11, wherein the light shade further comprises a shade mounting region to cooperate with the attachment plate, whereby the light shade is attached to the attachment plate at the shade mounting region.

16. The bulkhead light fitting as claimed in claim 2, wherein the light shade is a decorative component to which the attachment plate is secured, either releasably or permanently.

17. A method for illuminating the exterior of a spa or the area proximal to the exterior of a spa, comprising:

supplying a bulkhead light fitting comprising a base component that is mounted through a spa wall; a lens or light diffuser on an exterior end of the base component; a light source on, in, or proximal to an interior end of the base component; a light clip for retaining the light source on, in, or proximal to the base component; a light shade located on or proximal to the exterior end of the base component; and an attachment plate for attaching the light shade onto the base component; wherein the base component comprises a generally cylindrical hollow body having a hollow interior, a first end located within the spa wall, and a second end located proximal to the spa wall, and a generally planar mounting support attached normal to the generally cylindrical hollow body, wherein the attachment plate is mounted onto the mounting support;

attaching the base component to a spa wall by drilling a hole through the spa wall;

inserting the body component of the base component through the hole from the exterior of the spa such that a rear side of the mounting support contacts an exterior side of the spa wall;

screwing a nut onto a screw thread on the exterior of the body, and tightening the nut up against an interior side of the of the spa wall such that the spa wall is sandwiched between the nut and the rear side of the mounting support;

inserting the light source into the light clip, the light clip being attached to the light clip connector; and attaching a light shade, which is attached to the attachment plate to the mounting support.

18. The method for illuminating the exterior of a spa or the area proximal to the exterior of a spa as claimed in claim 17, wherein:

the attachment plate is mounted on the mounting support by sliding a region on the attachment plate that is shaped for cooperating with the shape of the mounting support over the mounting support such that the mounting support fits within the region shaped for cooperating with the shape of the mounting support; and locking or attachment clips on the attachment plate cooperate with notches on the mounting support to hold the light shade and the attachment plate combination onto the mounting support, wherein, when properly installed, the region for allowing light from the lens or light diffuser to pass through to the light shade lines up with the lens or light diffuser such that light passing through the lens or light diffuser is not blocked by the attachment plate and the light can proceed to and/or through the light shade.

* * * * *